US006056353A

United States Patent [19]

Meara

[11] Patent Number: 6,056,353

[45] Date of Patent: May 2, 2000

[54] FOLDING ADJUSTABLE CHAIR TO ACCOMMODATE JOINT DYSFUNCTION

[76] Inventor: Laura Meara, 20 Avery Rd., Montgomery, Mass. 01085-9551

[21] Appl. No.: 09/192,414

[22] Filed: Nov. 16, 1998

[51] Int. Cl.[7] ..... A47C 4/20

[52] U.S. Cl. ..... 297/41; 297/344.18; 297/60

[58] Field of Search ..... 297/39, 41, 59, 297/60, 344.18; 248/188.4, 188.5

[56] References Cited

U.S. PATENT DOCUMENTS

| | | | |
|---|---|---|---|
| 1,916,772 | 7/1933 | Pratt | 297/59 X |
| 1,922,418 | 8/1933 | Conant | 297/344.18 X |
| 2,917,104 | 12/1959 | Cottle | 248/188.5 X |
| 3,485,527 | 12/1969 | Barghout | 297/183.7 X |
| 4,772,068 | 9/1988 | Glecker et al. | 297/39 |
| 5,499,856 | 3/1996 | Sorrell et al. | 297/344.18 X |
| 5,848,822 | 12/1998 | Wu | 297/344.18 |

FOREIGN PATENT DOCUMENTS

| | | | |
|---|---|---|---|
| 684913 | 12/1952 | United Kingdom | 297/39 |

*Primary Examiner*—Peter R. Brown
*Attorney, Agent, or Firm*—Deborah A. Basile

[57] ABSTRACT

A lightweight, portable, adjustable folding chair accommodated specifically for persons with a joint disability which causes sitting or rising from a seated position to be difficult including partial or total hip replacement patients. The chair has adjustable height legs, solid cushioned seat and solid arm rests. The feet of the chair are covered with replaceable rubber tips for safety. The chair may be folded for transport and storage. A handle within the backrest is included for ease of carrying.

5 Claims, 4 Drawing Sheets

20
9
1
8
11
3
10
2
6
5
18
17
19
14
15
4
13
12

FOLDING ADJUSTABLE CHAIR TO ACCOMMODATE JOINT DYSFUNCTION

BACKGROUND OF THE INVENTION

1. Field of the Invention

This invention relates generally to the class of devices designed to accommodate persons with any disability in which sitting or rising from a seated position is difficult or in which certain restrictions for seat heights on chairs are recommended, including but not limited to patients who have undergone partial or total hip replacement.

2. Information Disclosure Statement

Currently there are three devices known to the inventor which address the need for an adjustable collapsible chair. No known device addresses the specific needs of a person with joint dysfunction. There are adjustable chairs which have legs with hollow sleeves and telescopic struts which are adjustable within the sleeve to shorten or lengthen the leg. In most cases, a flexible compression member is restrained within the hollow sleeve which is connected at one end to its respective strut and at the other to an adjustment means for selectively adjusting the length of the leg. Similarly, there are chairs which have adjustable back rests. These chairs are improvements over conventional chairs for individuals with particular needs.

However, there is no chair known to the inventor which is specifically designed to accommodate a person with a disability which renders the act of sitting or rising from a seated position difficult or in which certain restrictions as to seat height or seat pitch are necessary or recommended. For an individual with a partial or total hip replacement, for example, a chair must have adjustable height legs, a solid cushioned seat, and solid arm rests. Further, ideally, the seat of the chair should be positioned so that the hip does not exceed a 90° angle with the lower extremities when the patient is seated. Following a hip replacement, within the hip joint the femoral head glides posteriorly as the lower extremity is flexed at the hip. The likelihood of dislocation is increased considerably when the angle created by the hip and the lower extremity exceeds 90°. Following surgical repair, the muscle and the joint capsules are weakened increasing the risk or likelihood of dislocation. A patient must adhere to strict protocol which includes eliminating internal rotation of the hip joint or adduction of the lower extremity in an attempt to avoid dislocation and to decrease the risk of injury. Forward trunk flexion should also be avoided. This hip replacement protocol must be followed for three to six months after surgery.

Using an adjustable height chair will prevent the risk of dislocation as well as internal rotation and adduction of the lower extremities. The patient must sit in an armed chair at an appropriate height so that the patient's hip does not exceed a 90° angle with his or her lower extremities. Most acceptable is for the patient's knees to be lower than the hip joint(s) when seated. This is not accomplished using a conventional chair or any typical seating arrangements.

There are adjustable chairs as mentioned above which are not specifically adapted for use by a person with a joint disability and are unfit for such use. In addition to those chairs, there are other pieces of adaptive equipment meant to assist total hip replacement patients with daily living such as adjustable bathtub seats, and equipment to convert toilet seats.

Conventional seating in many residences is completely inadequate to accommodate total hip replacement protocol.

Absent an appropriate chair, it is necessary for total hip replacement patients to apply makeshift adjustments to their domestic furniture such as adding foam cushions to the seats, pillows to the back rests and blankets to the seat and backrest to increase the elevation of the seat of the chair or to adjust the angle of the hip when seated. Individuals may construct platforms to elevate a conventional chair. These makeshift adjustments are inefficient, ineffective, unsightly and can be dangerous to the patient or to other occupants of the home as they are often insecure and unstable. A chair perched on such a makeshift platform can easily slide off of the platform and further injure a seated patient. In addition, a patient with a disability might trip over a makeshift platform. Such bulky adjustments are inconvenient for family members who are not disabled.

Frequently patients who have had total hip replacement will add pillows to their seats to raise themselves to an acceptable height to maintain a greater than 90° angle between their hip joint and their lower extremities. As the patient adds height by adding pillows to their seats, the arm rests remain at the same level and then offer no assistance in rising. Patients may injure themselves due to the weakened musculature and joint capsules as a result of surgery if they are unable to rely on firm arm rests for assistance in rising.

Clearly, what is needed, and hence, what would contribute to the state of the art, is a portable, yet sturdy, adjustable chair with appropriate adjustable seat height and arm rests to accommodate the problem posed by inadequate seating for hip replacement patients.

The following patents are known to the Inventor and are disclosed:

1. Condos U.S. Pat. No. 5,516,197
2. Wilson U.S. Pat. No. 5,494,333

Condos teaches an adjustable chair for use in a business setting. The legs are adjustable by flexible compression spring action and the partial backrest is adjustable, fore or aft for comfort. Both adjustments are made by levers. The chair is not suitable for a patient with hip dysfunction because it lacks arm rests and the base and backrest are not of sufficient size or stability. The chair is not portable, nor is it foldable or lightweight.

Wilson teaches a foldable lawn chair which has three adjustable leg extensions including leg extension locking means. The chair is not suitable for a patient with joint dysfunction as it does not have a solid seat and backrest. Also a patient would require four solid legs and wider arm rests for stability. It is not suitable as well because the rear leg would not be adjustable on a different plane than the front legs to create the required hip angle for a joint patient. The Wilson chair is designed for use on an incline or decline, such as a sporting event.

OBJECTS OF THE INVENTION

It is an aim of the present invention to provide a chair which is comfortable and appropriate for a patient with a disability such as a partial or total hip replacement. Such chair will comply strictly with the requirements of the total hip replacement protocol following surgery.

It is an aim of the present invention to provide a lightweight folding, adjustable chair made of aluminum having solid arm rests and rubber tipped legs.

It is an aim of the present invention to avoid the need for makeshift adjustments to home seating to accommodate a person with a joint disability.

It is a further aim of the present invention to have a portable, adjustable folding chair which would enable a patient to visit their family and friends, go out to a restaurant, and take the chair to a sporting event or outdoor party.

The above, and other objects, features and advantages of the present invention will become apparent from the following description read in conjunction with the accompanying drawings.

BRIEF SUMMARY OF THE INVENTION

Briefly stated, the present invention is a folding, adjustable, lightweight chair, made of aluminum, having adjustable height legs, a solid cushioned seat and solid arm rests. The solid cushioned seat provides comfort, the needed support for posterial alignment, and even weight distribution. The back of the chair is made of a solid material and has a built-in handle for easy carrying. Solid arm rests provide comfort and safety allowing the patient a solid surface for support when sitting or rising from the seat. The feet of the chair are covered with replaceable rubber tips, to prevent the chair from slipping when shifting weight, sitting and rising. The chair folds for transport and easy storage.

The chair provides easier hospital-to-home transition for the patient without requiring remodeling or makeshift adjustments to the existing home furniture. The adjustable height and portability of the chair allows for secure seating for the patient in any home, office or restaurant further enabling the patient to return quickly following surgery to his or her previous activities in the home and outside of the home.

The chair provides and maintains proper joint alignment and protection from further injury for the patient. The legs are adjustable in length by a tension set pin, such as a hairpin, set inside the legs. The head of the pin is a button, which extends out of an aperture in each leg to secure the leg in place, and which is depressed to adjust the leg height. To prevent the legs from collapsing, a safety locking means is added to the legs. All four legs may be at different heights, the same height, or two rear legs may be higher or shorter than the two front legs. The legs are further supported by compressible cross bars.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE DRAWINGS

Figure 1:
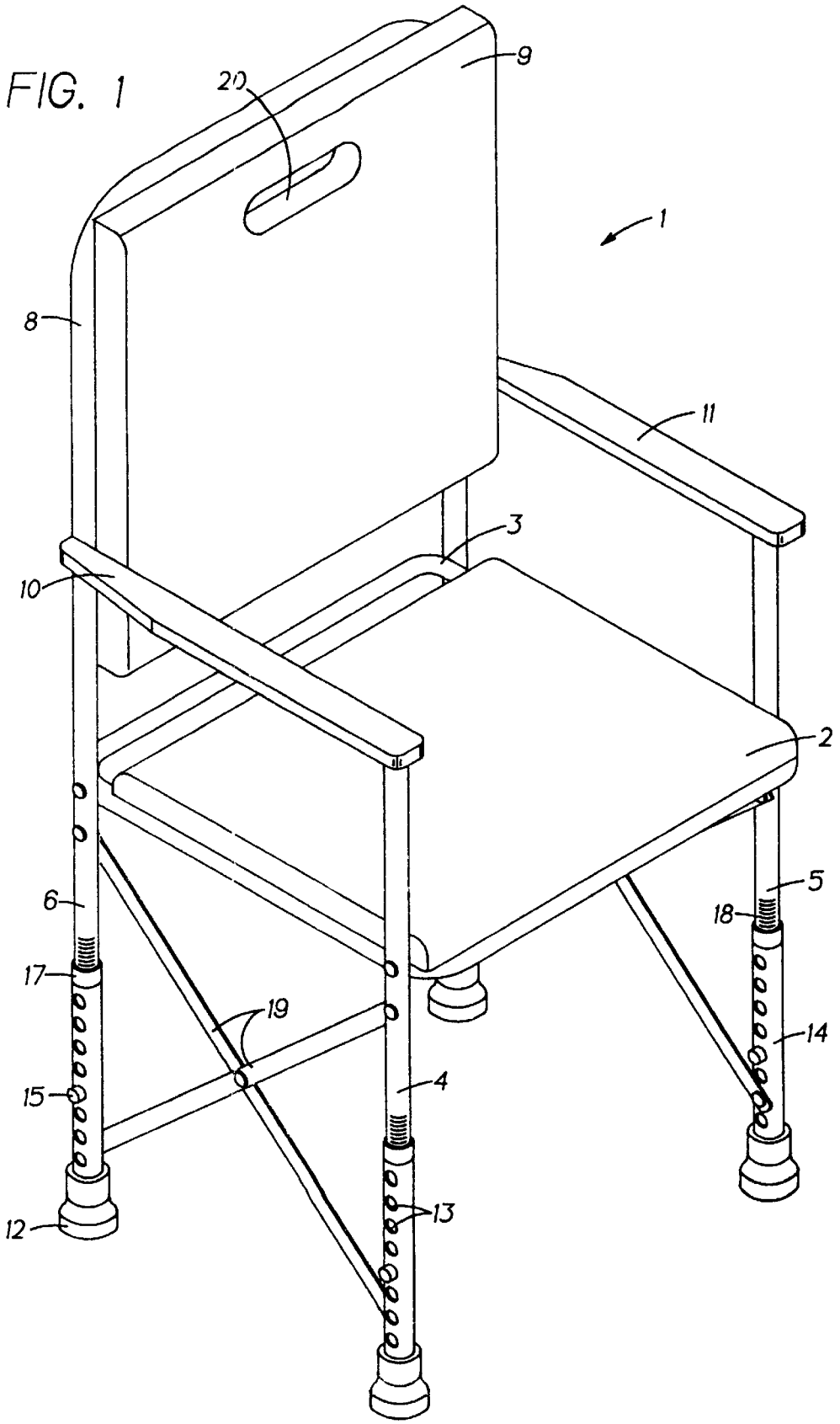
FIG. 1 is an isometric drawing of the preferred embodiment of the present invention.
Figure 2:
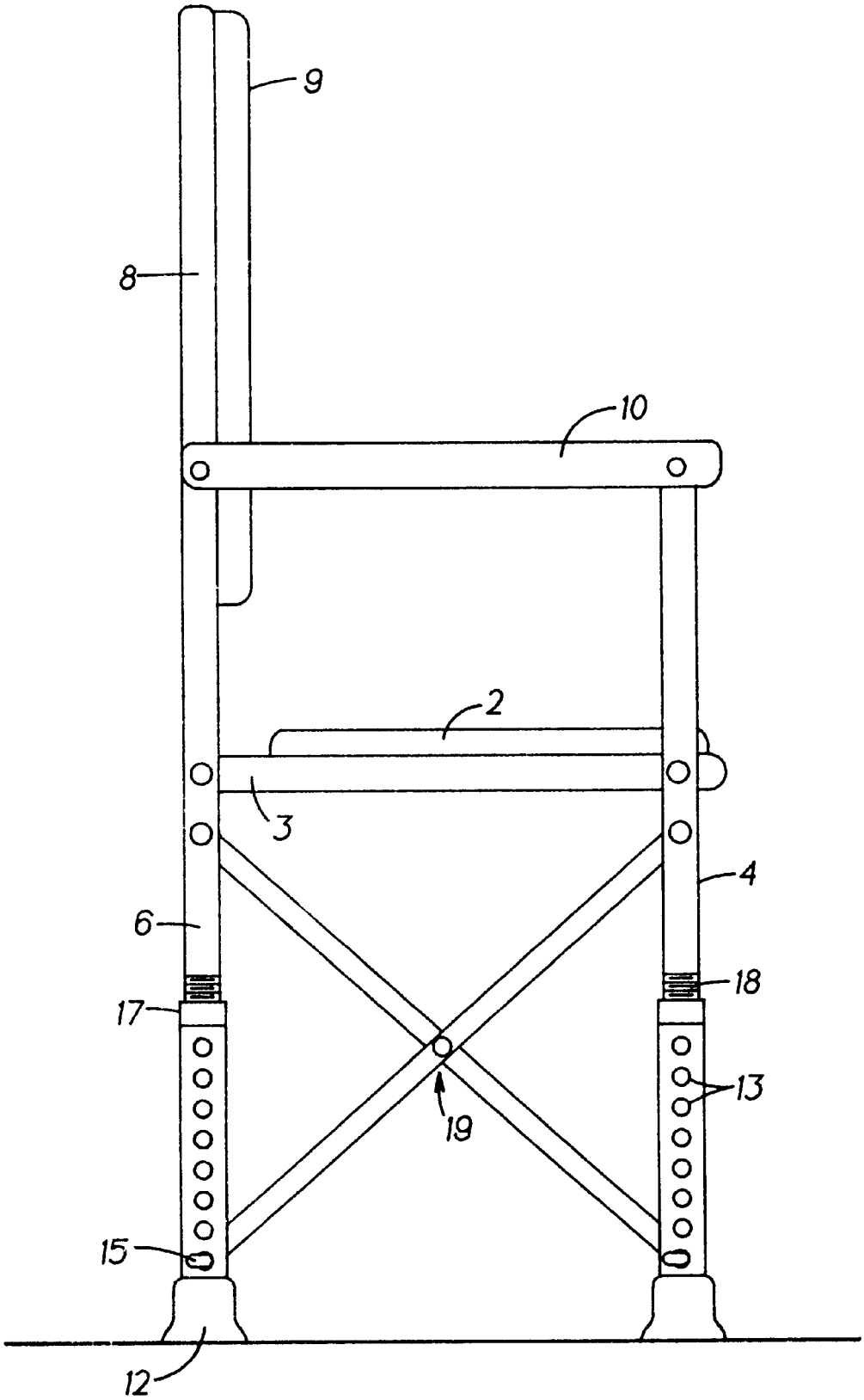
FIG. 2 is a detail of the relative dimensions of the preferred embodiment and a side view of the present invention.
Figure 3:
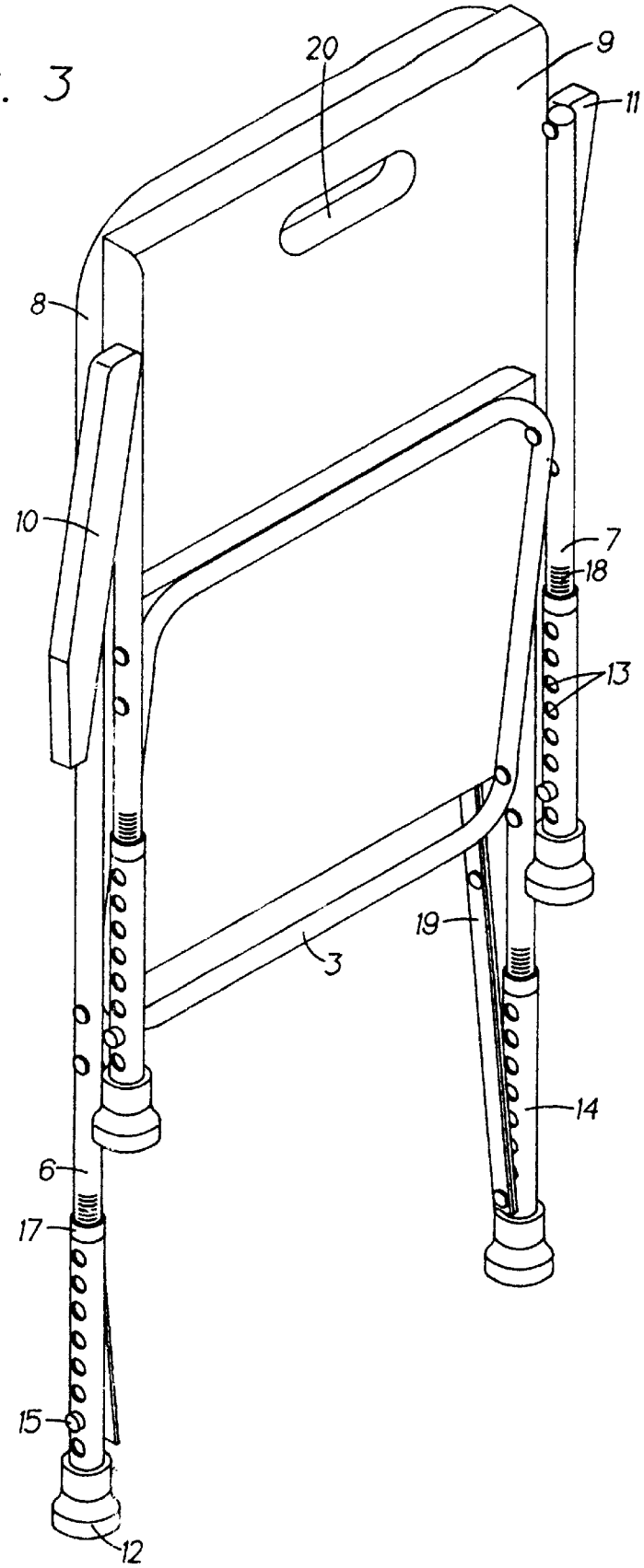
FIG. 3 is a view of the chair in a folded position.

Shown in FIGS. 1–3, is the chair 1 in accordance with the present invention. The chair 1 has a solid seat 2 mounted on a seat frame 3, four legs 4, 5, 6, 7, a back frame 8 attached to the seat frame 3 and a solid backrest 9 mounted on the back frame 8. Extending from the back frame 3 are two arm rests 10, 11.

The seat frame 3 is a member sized and shaped so as to form a solid support upon which the solid seat 2 rests. The seat frame 3 is preferably in the form of a continuous bar in the shape of a square or rectangle as shown in FIG. 1. Because the chair 1 is ideally lightweight and portable, yet sturdy, the seat frame 3 is preferably a hollow elongate aluminum bar.

The solid seat 2 is preferably cushioned for seating comfort. The cushioned seat 2 has a depth that provides comfort but does not compromise the needed support for posterial alignment and even weight distribution of a patient requiring use of the chair 1. The seat 1 is preferably square or rectangular, with side lengths adapted to the seat frame 3 dimensions. Thus, for the seat 2 to solidly rest on the seat frame 3, the seat 2 should be slightly larger than the seat frame 3. However, as shown in FIG.1, for example, the width of the seat 2 may be larger than the seat frame 3 width, while the length of the seat 2 is shorter than the seat frame 3 length and still provide a solid support.

The chair has four legs. A first front leg 4, second front leg 5, first back leg 6 and second back leg 7 are attached to the seat frame 3. The legs 4, 5, 6, 7 are preferably pivotally attached to the seat frame 3 so as to allow folding of the chair 1 as shown in FIG. 3. The four legs 4, 5, 6, 7 are preferably fabricated of aluminum. Because the legs are attached to the seat frame 3, the distance between the legs 4, 5, 6, 7 depends on the size of the seat frame 3.

Replaceable feet 12 are mounted on the four legs 4, 5, 6, 7. These feet have tips of rubber or a similar material to prevent the chair from slipping when shifting weight, sitting and rising.

To form a more sturdy chair 1, a back frame 8 extends from the first back 6 leg to the second back leg 7. The back frame 8 may be an inverted U-shaped continuous extension of the first and second back legs 6, 7, where the first and second back legs 6, 7 extend from the linear ends of the inverted U. Again, because the chair 1 is ideally lightweight and portable, yet sturdy, the back frame 8 is preferably fabricated of aluminum.

A solid backrest 9 is mounted on the back frame 8. The solid backrest 9 is preferably cushioned. The cushioned backrest 9 has a depth sufficient to provide comfort but not too deep so as to compromise the needed support for back alignment. The solid backrest 9 is sized and shaped such that it is solidly supported by the back frame 8.

A first arm rest 10 is connected to the back frame 8 and extends towards and connects to the first front leg 4. A second arm rest 11 is connected to the back frame 8 and extends towards and connects to the second front leg 5. Preferably, the arm rests 10, 11 are pivotally connected to the back frame 8 and the two front legs 4, 5 to allow folding of the chair 1 as shown in FIG. 3. To provide assistance in rising from the chair, the arm rests 10, 11 are solid and sufficiently wide. Because the arm rests 10, 11 of the present invention are attached to the back frame,8, which is a continuous extension of the adjustable legs 4, 5, 6, 7, the arm rests are raised along with the seat 2 as the legs 4, 5, 6, 7 are adjusted. Thus, a patient will still have the needed support of the arm rests 10, 11 when the seat is raised.

In the first and second back legs 6, 7 are a plurality of apertures 13. The apertures are distributed 13 linearly upwards from the feet 12, preferably at 1 to 1.5 inch intervals. The apertures 13 are distributed in a sleeve 14 that covers the bottom portion of the legs 6, 7. The sleeve 14 is a tube-like member that fits over the legs 6, 7. The first and second front legs 4, 5 may also include these apertures 13 and sleeves 14.

Figure 4:
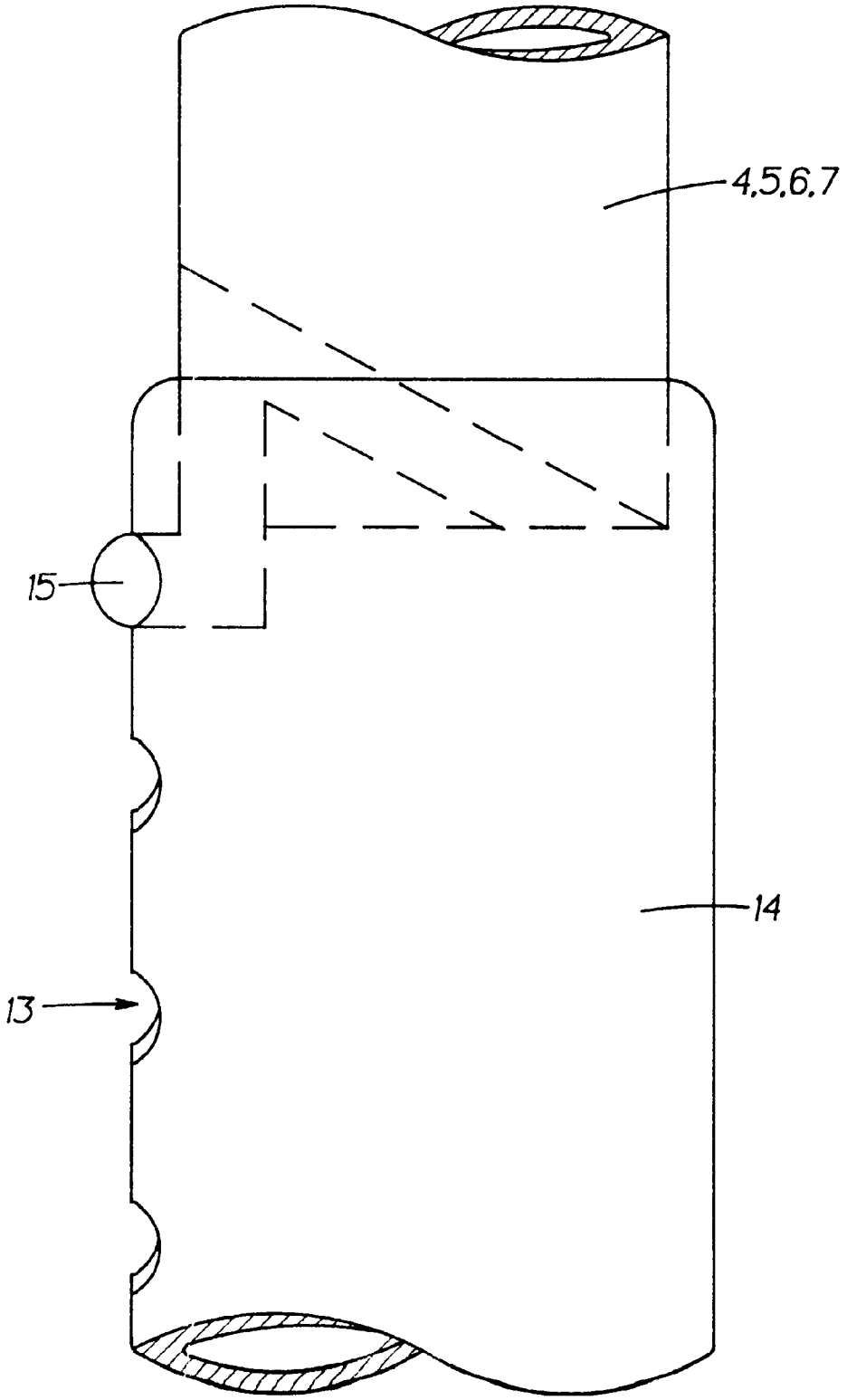
FIG. 4 is an enlarged view of the fixture in the form of a hairpin with the leg and sleeve of the chair removed to show the position of the hairpin.

A fixture 15 is secured within an aperture 13 on the legs 6, 7 to secure the legs at a specific height corresponding to the aperture 13. Thus, for example, where the fixture 15 extends through the third aperture 13, if the interval between apertures is 1 inch, the leg has a height of 3 inches greater than the natural chair height. These fixtures 15 may be easily adjusted to secure each back leg 6, 7 at a height corresponding to a chosen aperture 13. For example, the fixtures 15 may be pins, which are tension set inside of the legs. The fixtures 15 preferably is a type of hairpin shown in FIG. 4, having a button 16 portion extending out of the aperture 13 that is pushed to depress the button into the aperture 13. This allows the leg to slide up or down inside the sleeve 14 to adjust leg height up or down. A plurality of fixtures 15 like those in the two back legs 6, 7 may also be in the first and second front legs 4, 5.

The legs 4, 5, 6, 7 are preferably independently telescopically adjustable. Thus, for example, all four legs 4, 5, 6, 7 may be adjusted to equal height, or the two back legs 6, 7 may be adjusted to a height greater than the two front legs 4, 5.

To more securely lock the legs 6, 7 at a given height within an aperture 13, a safety locking means 17 is mounted on the legs 6, 7. The safety locking means 17 may comprise a threaded ring that slides up and down the legs 6, 7 above the sleeves 14. When a fixture 15 is secured in an aperture 13, the ring is slid just above and in engagement with the top of the sleeve 14 and fixed or tightened at that location. This prevents the leg from sliding down inside the sleeve 14 if the fixture 15 is disengaged. The ring may have a threaded hole in its side with a bolt that is screwed into the hole to fix the ring at a given location on the leg 6, 7. The front legs 4, 5 may also have a safety locking means 17.

To provide added support, compressible cross bars 19 may be added. The cross bars 19 extend from the first front leg 4 to the first back leg 6 and from the second front leg 5 to the second back leg 7. The cross bars 19 reinforce the front legs 4, 5 and back legs 6, 7 to provide increased chair 1 stability. The compressibility of the cross bars 19 allows the chair 1 to be folded. The cross bars are joined together in the center and joined to the legs at their ends, with connecting means which allow for movement of the cross bars relative to each other so that when the chair is folded, the cross bars lie parallel to each other, as shown in FIG. 3.

Because the chair is designed to be portable, the chair 1 has a handle 20 for easy holding and carrying of the chair 1. The handle 20 is preferably in the form of an oval aperture in the solid backrest 9.

Having described the preferred embodiment of the invention with reference to the accompanying drawings, it is to be understood that the invention is not limited to those precise embodiments and that various changes and modifications may be affected therein by one skilled in the art without departing from the scope or spirit of the invention as defined in the appended claims.

I claim:

1. A chair constructed of lightweight, sturdy material particularly adapted for use by joint dysfunctional patients comprising:

A solid cushioned seat;

The solid seat mounted on a seat frame;

A first front leg and second front leg attached to the seat frame;

A first back leg and second back leg attached to the seat frame;

Feet mounted on the first and second front legs and first and second back legs;

A back frame extending from the first back leg to the second back leg;

A solid cushioned backrest mounted on the back frame having a handle in the form of an aperture;

A first and second arm rest connected to the back frame;

A sleeve on the first and second back legs and on the first and second front legs;

A plurality of apertures in the sleeves; and

Fixtures secured within one of said apertures on the sleeves whereby said fixtures may be easily moved from one aperture to another to secure the back legs at a desired height depending on the chosen aperture and to secure the front legs at a desired height (which may be different from the height of the back legs) depending on the chosen aperture;

Said first arm rest pivotally connected to said back frame and extending towards and pivotally connected to the first front leg;

Said second arm rest pivotally connected to said back frame and extending towards and pivotally connected to said second front leg whereby the pivotal attachments allow the chair to be folded;

Said chair further comprising compressible crossbars extending from the first front leg to the first back leg and from the second front leg to the second back leg whereby said front legs and said back legs are reinforced and said crossbars being movably connected together and to said front legs and said back legs so as to lie parallel to each other when said chair is folded.

2. The chair as in claim 1 wherein the fixture is a type of tension set pin, such as a hairpin, set inside of the legs, the pin having a V-shaped body portion fixed within the legs so that the pointed end of the V extends into the leg, and a button portion at an open end of the V that extends out of the leg and through an aperture on the sleeve, whereby the button is pushed to depress the button into the aperture and allow the leg to slide up or down inside the sleeve to adjust leg height up or down.

3. The chair as in claim 2 further comprising security locking means engaged entirely around each of the first front leg, second front leg, first back leg, and second back leg.

4. The chair as in claim 3 wherein the security locking means is a threaded ring that slides up and down above the sleeves on the first front leg, second front leg, first back leg, and second back leg, and which is tightened to further secure the leg at a given height.

5. The chair as in claim 1 wherein the apertures are distributed in the sleeves in increments of 1 to 1.5 inches and the front and back legs are independently telescopically adjustable at increments of 1 to 1.5 inches.

* * * * *